United States Patent [19]

Stephens

[11] Patent Number: 4,810,097

[45] Date of Patent: Mar. 7, 1989

[54] DISPENSING APPARATUS

[76] Inventor: Anthony L. Stephens, 3511 Pacific Highway, Springwood, Australia, 4127

[21] Appl. No.: 77,938

[22] Filed: Jul. 27, 1987

[30] Foreign Application Priority Data

Dec. 1, 1986 [AU] Australia ..... PH 9265

[51] Int. Cl.[4] ..... B01F 15/02; B28C 5/00

[52] U.S. Cl. ..... 366/9; 222/139; 222/239; 366/20; 366/35; 366/38; 366/40; 366/606

[58] Field of Search ..... 366/45–47, 366/185, 162, 40, 20, 26, 27, 35, 64, 66, 76, 154–156, 177, 182, 341, 349, 606; 222/164, 132, 166, 139, 239, 240; 414/381, 425

[56] References Cited

U.S. PATENT DOCUMENTS

| | | | |
|---|---|---|---|
| 900,227 | 10/1908 | Svenson | 366/46 |
| 1,546,390 | 7/1925 | Lichtenberg | 414/381 |
| 1,674,989 | 6/1928 | Powell | 366/185 |
| 1,920,025 | 7/1933 | Thordsen | 366/47 |
| 3,260,176 | 7/1966 | Bowers | 366/45 X |
| 3,409,328 | 11/1968 | Hamby et al. | 222/166 |
| 3,792,838 | 2/1974 | Jacopini et al. | 366/45 |
| 4,027,787 | 6/1977 | Bibeau et al. | 222/166 |
| 4,511,154 | 4/1985 | Daloisio | 414/425 |
| 4,538,916 | 9/1985 | Zimmerman | 366/40 |
| 4,624,577 | 11/1986 | Vannier et al. | 366/83 |

*Primary Examiner*—Timothy F. Simone
*Attorney, Agent, or Firm*—Helfgott & Karas

[57] ABSTRACT

A dispensing apparatus is located in the rear of a tip truck body. When the tipping body of the truck is inclined gravity causes bulk material held in the tipping body at either side of a partition to feed augers. The dispensing apparatus includes at least one tank preferably a central tank holding powdered material such as cement powder dispensed through a chute by virtue of a paddle wheel dispenser. Water tanks which dispense water through an outlet are located at either side of the cement powder tank. A common drive shaft drives the augers and the paddle wheel. The dispensing of material is controlled by controllers such that a predetermined ratio of material can be dispensed into, for example a mixer. The dispenser can be used for dispensing the constituents of concrete and may be removable from the tip truck body so that the tip truck can function as a normal tip truck.

13 Claims, 4 Drawing Sheets

DISPENSING APPARATUS

THIS INVENTION relates to dispensing apparatus, in particular to apparatus for dispensing two or more materials from a tipping body so that the dispensed materials may subsequently or simultaneously be mixed in predetermined ratios to form a mixture of predetermined characteristics.

The present invention is particularly suited for use in dispensing bulk particulate materials from a tipping body, such as a tip truck having one or more hydraulic means enabling a walled deck to be tipped relative to the horizontal for gravitational discharge of the bulk material stored in the body. The tipping body used with the present invention may be wheeled for transportation of the stored material or may be such as to remain stationary and have bulk materials transported to the tipping body for storage and subsequent dispensing.

The tipping body may have one or more fully enclosed storage regions or alternatively open storage regions as in conventional tipping trucks.

The present invention has particular application to the preparation of wet mixtures which combine a number of dry ingredients with one or more wet ingredients. Such mixtures include wet concrete mixtures, hot bitumen asphalt mixtures, road base mixtures, molasses based animal feed mixtures and similar mixtures.

In each of the above-mentioned mixtures there are substantial differences in character between the ingredients. When a wet mix is stored the ingredients tend to differentiate. In the case of the wet concrete mix it is desirable to ensure a homogeneous mixture when pouring a concrete structure.

The invention will be described with particular reference to the preparation of concrete, but it will be understood that the invention is not limited to the described embodiment.

In the preparation of concrete for construction of buildings and the like, central storage facilities traditionally are employed for storage of cement powder, water, gravel and sand. These central storage facilities are generally known as batching plants. The concrete ingredients are dispensed from the batching plants into a conventional agitator bowl which continuously tumbles the mixture to prevent both differentiation and premature curing of the mixture.

Two major problems exist in the traditional system outlined above. First, the system requires double handling of bulk ingredients, namely there is the initial transportation of bulk ingredients from the quarry to the batching plant where the ingredients are loaded into storage, and then the ingredients are dispensed into the agitators for transportation to the construction site. Secondly, the agitator vehicles are highly specialised vehicles having no use other than the transportation of the wet mix. Mobile batching plants have been developed to avoid the double handling, e.g. as described in U.S. Pat. Nos. 4,624,577 and 4,538,916. However, the vehicles employed in such batching plants are again of a very specialised nature.

It is an object of the present invention to provide a novel dispensing apparatus which eliminates the need for central storage facilities such as batching plants.

It is another object of the present invention to provide a dispensing apparatus suitable for use with conventional tipping trucks to replace the hitherto known specialised vehicles mentioned above.

In one broad form, the present invention provides a dispensing apparatus suitable for use with transportable container means for dispensing constituents of a desired mixture, said container means being tiltable from a substantially horizontal attitude to an inclined attitude and said apparatus being located at the lower end of the container means when inclined; wherein said apparatus comprises receiving means for receiving at least one constituent from said container means by gravitational delivery, first dispensing means for dispensing the received constituent(s) at a predetermined rate; storage means for storing at least one further constituent in said dispensing apparatus; and second dispensing means for dispensing said further constituent(s) from said storage means at a predetermined rate.

In a preferred embodiment the dispensing apparatus of the invention is in the form of a removable module which may be secured in the rear of a conventional tipping truck. Accordingly, by virtue of the non-specialised nature of vehicles to which the dispensing apparatus can be applied, the vehicles can be used for normal haulage applications in industries during such time as they are not being used for the transport and metered dispensing of particulate building and construction materials, or animal feedstocks, or fertilizers, etc.

The removable module includes one or more independent storage containers which store liquid and/or flowable particulate constituents of a mixture and which are to be combined with normally greater amounts of other constituents held in the tipping body. The constituents may be dispensed solely by gravity feed or by combined gravity and forced feeding. For example where a liquid constituent is being dispensed from the module an air space within a sealed container may be pressurised to increase the rate at which the liquid is dispensed.

Preferably the module containers adopt one attitude during transportation and a second attitude for dispensing. In a preferred embodiment, one container is adapted to hold a powdered substance, and in its dispensing attitude is in the form of a generally inverted pyramid.

The dispensing apparatus includes metering mechanisms to which the respective particulate materials being dispensed are directed by convergent walls. Preferably, the mechanisms are driven from a common drive to ensure that the constituents are dispensed in a constant ratio.

Advantageously, the outlets of the dispensing apparatus are arranged so that the dispensed ingredients converge and mix at least partially. This arrangement is particularly applicable to dry constituents before the subsequent addition of liquid constituents and the final full mixing.

In order that the invention may be more readily understood and be put into practical effect reference will now be made to the accompanying drawings and wherein.

Figure 1:
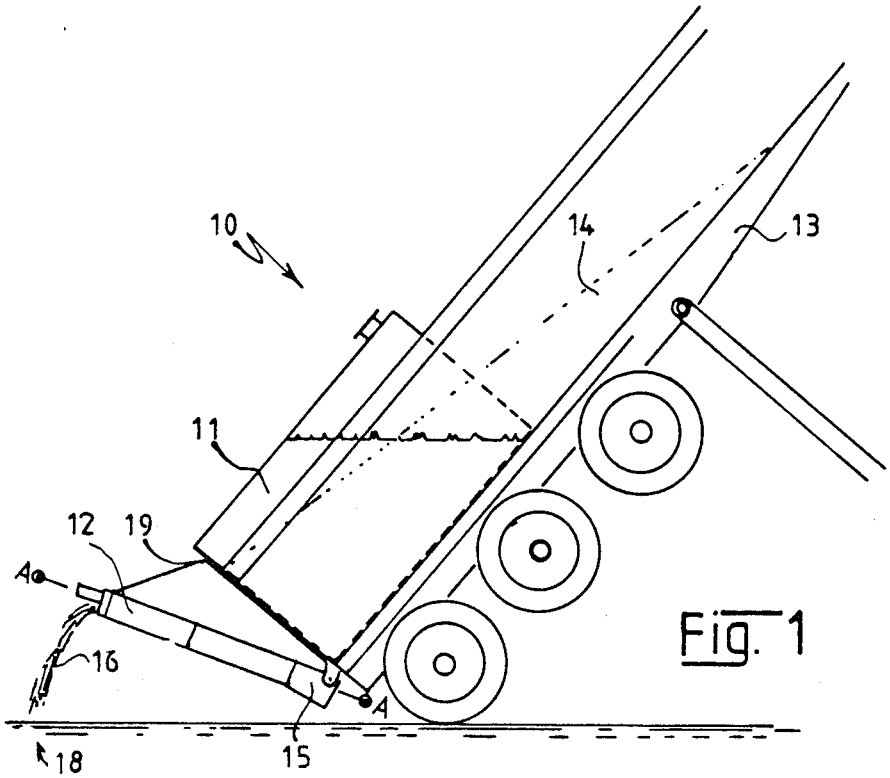
FIG. 1 is a side elevational view of a preferred embodiment of the invention as applied to a tip truck.

As shown in the drawings, particularly FIG. 1, the dispensing apparatus 10 of the preferred embodiment comprises a removable module 11 to which is attached a mixing discharge conveyor 12. The module 11 is operatively secured at the rear of a tipping trailer 13 which is illustrated in its tipped or tilted attitude. The module 11 includes a water tank and a cement powder tank. The module also provides passages or conveyor means which are gravitationally fed with bulk material such as sand and gravel 14 from the tipper trailer 13. Water and cement powder are dispensed from the module 11 at a controlled rate. The sand and gravel 14 is metered along with the prescribed quantities of water and cement powder into a hopper 15 of an articulated mixer discharge conveyor 12 where the predetermined quantities of the constituents of the resulting concrete mixture are mixed and finally discharged through outlet 17 directly at the construction site 18.

An electric winch 19 may be provided to elevate the conveyor 12 from a discharge position to a transport position when the tipping trailer is in its horizontal attitude.

The tipping trailer may be fixed to a prime mover and driven directly to the quarry to be loaded or reloaded with sand and gravel before returning to the construction site. In other words, the materials are transported directly from quarry to construction site without the need for intermediate storage or dispensing at a batching station.

Figure 2:
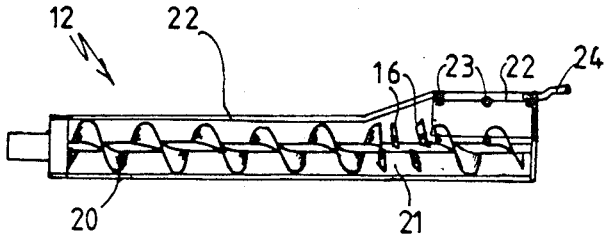
FIG. 2 illustrates a cut-away section through A—A of FIG. 1.

Referring now to FIG. 2 there is illustrated in cutaway view the interior of the mixing discharge conveyor 12. An auger 20 having interrupted flights 21 is housed within a resilient cylindrical housing 22 of rubber or the like material. The interrupted flights are preferably located near the hopper 15 of the mixer 12 and serve to allow the concrete constituents to "fall back" towards hopper 15 and thereby mix further. Any suitable number of interruptions may be used depending on the required degree of mixing. As illustrated the interruptions include a number of radial angled fingers 16 which in themselves are preferably adapted to convey material being mixed toward the discharge end by being angled to the transverse. The net effect of the interrupted flights is to provide both a "falling back" and a conveyor effect on the materials within the casing to ensure a predetermined mixing effect. Of course variations in the angle to the horizontal of the mixer conveyor 12 will also allow the degree of mixing to be varied.

The resilient casing 22 is able to resiliently deform to prevent jamming of incompressible particles such as rock particles between the auger blade and the casing. This enables the clearance between the blades and the casing to be minimised.

Water is dispensed into the hopper 15 via a peripheral pipe 22 having a plurality of spaced outlets 23. Pipe 23 communicates with the water tank in module 11 via a flexible hose 24.

Although FIG. 2 illustrates one form of mixer, other mixing means may be utilised in conjunction with a dispensing apparatus according to the invention. In one alternative arrangement the constituents may be dispensed into a horizontal mixing auger which extends the full width of the trailer tailgate and has articulated at its discharge end a spreading auger similar to the mixer of FIG. 2 but serving only to convey the mix. The mixer may be integral with the dispensing apparatus or independent thereof.

For instance, conventional mixers may be used, such as the revolving bowl type agitators. In this case a ramp may be employed to suitably locate the dispenser above the agitator bowl. As a further alternative one or more intermediate conveyors may be used to transmit the dispensed constituents up to the agitator bowl.

Figure 3:
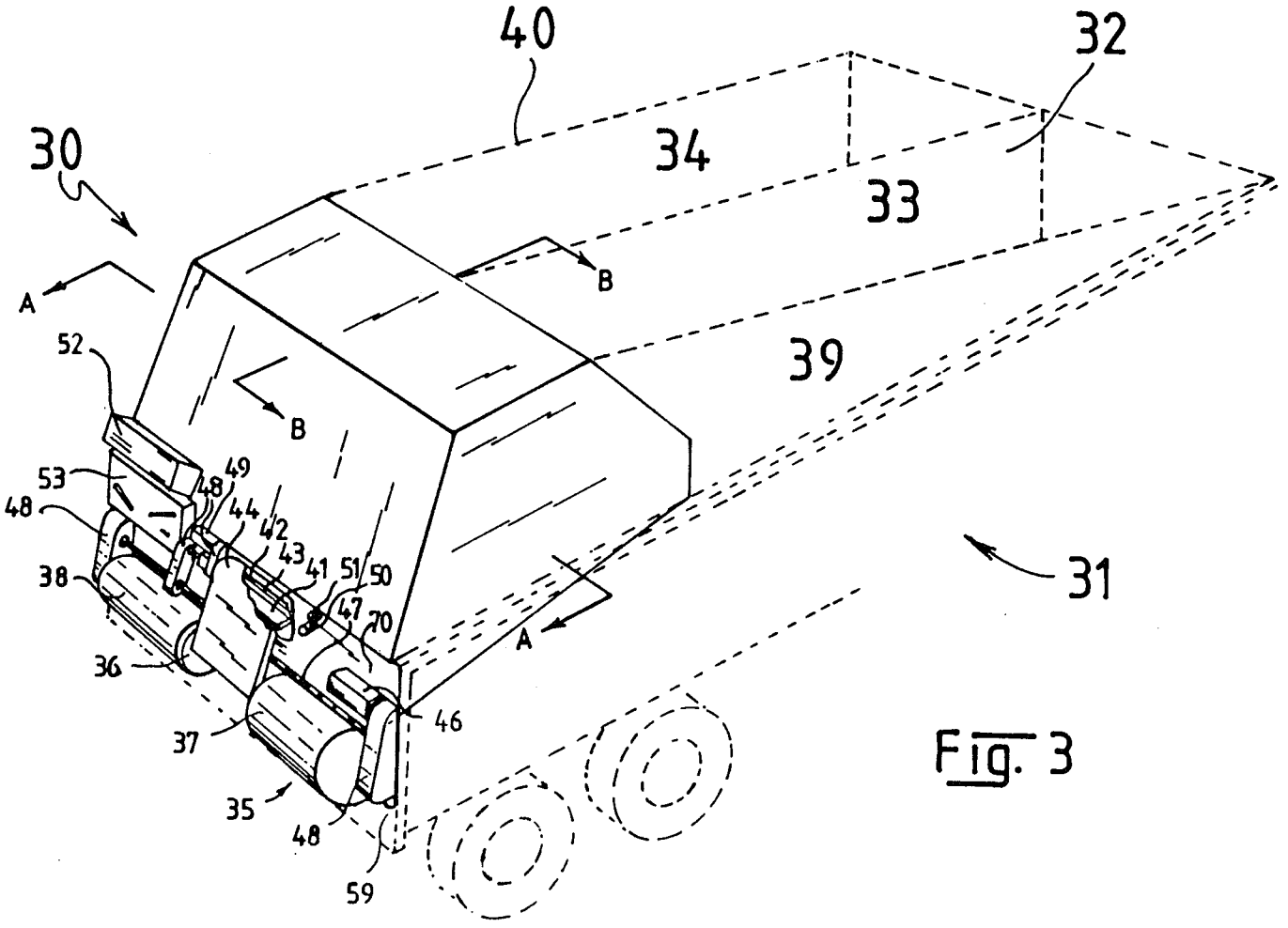
FIG. 3 is a perspective view of a second preferred embodiment of the invention as applied to a tip truck.

A second embodiment of the dispensing apparatus of the present invention is illustrated in FIG. 3. The apparatus comprises a removable module 30 operatively secured in the rear of a tipping trailer body 31 (shown in hidden detail). The internal structure of module 30 will be described below with reference to FIGS. 4 to 7. The tipping trailer body includes a central partition 32 dividing the tipping body into two longitudinal storage regions 33 and 34 which communicate independently with first and second augers 35 and 36, respectively, in the dispensing apparatus. The augers 35 and 36 are housed inside resilient casings 37 and 38 which may be detached for cleaning purposes. The augers 35 and 36 serve to convey bulk material from regions 33 and 34 to a central position in the tailgate. The augers are fed gravitationally when the tipping body 31 is tipped.

In order to prevent material held in the regions 33 and 34 from overflowing when the body is tipped the partition 32 and side walls 39 and 40 taper upwardly toward the rear of the tipping trailer.

A paddle wheel dispenser 41 having a plurality of radial blades 42 is rotatably mounted at the base of a cement powder tank 60 which is sandwiched between two water tanks 61, 62. The blades 42 include resilient edges 43 which resiliently deform as the blades contact the rigid housing 44 to sweep cement powder down the chute 45 into the central tailgate region. A single hydraulic motor 46 drives a common drive shaft 47 which extends across the rear of the dispenser. The augers 35 and 36 and the cement wheel 41 are driven from the common drive by toothed gears and chains which are housed in removable chain guards 48. The relative speeds of the augers may be changed by changing the gearing to effect a change in constituent throughput and ratio. Typically, the outlets for the augers 35 and 36 and cement chute 45 are so positioned so that dispensed materials converge and mix to some degree prior to entering a mixer proper. In some cases the premixing will be sufficient to fully combining the dry ingredients. Powder constituents such as cement powder tend to agglomerate in a "balling" effect when wet. Hence the coalesing of dry ingredients provides a precoating of the gravel and sand prior to mixing the water.

In addition the cement wheel drive includes a variable speed gear box 49 which enables the ratio of cement powder to gravel and sand to be varied. By using a common drive shaft any resistance causing slowing of say, auger 35, will result in comparable slowing of auger 36 and cement wheel 41. Consequently the ratio of ingredients in the resulting mix will remain constant.

A water outlet 50 is connectable to a flexible hose (not shown) in order to dispense water. A valve 51 is used to regulate flow of water and an internal flow meter reads out flow rate on the digital readout of the control panel 52. The control panel 52 may also include a cumulative total of material dispensed at any particular time and preferably monitors the rotations of common drive shaft 47 and is calibrated in terms of cubic measure of dispensed material. A further control panel 53 has switches to activate the drive and activate other operational features which will be described below.

Figure 4:
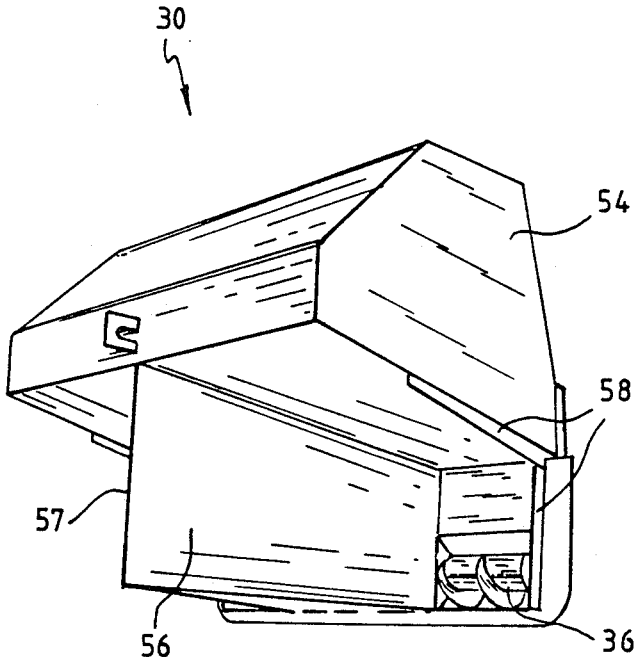
FIG. 4 is a perspective view from one side of the dispensing apparatus of FIG. 3.
Figure 5:
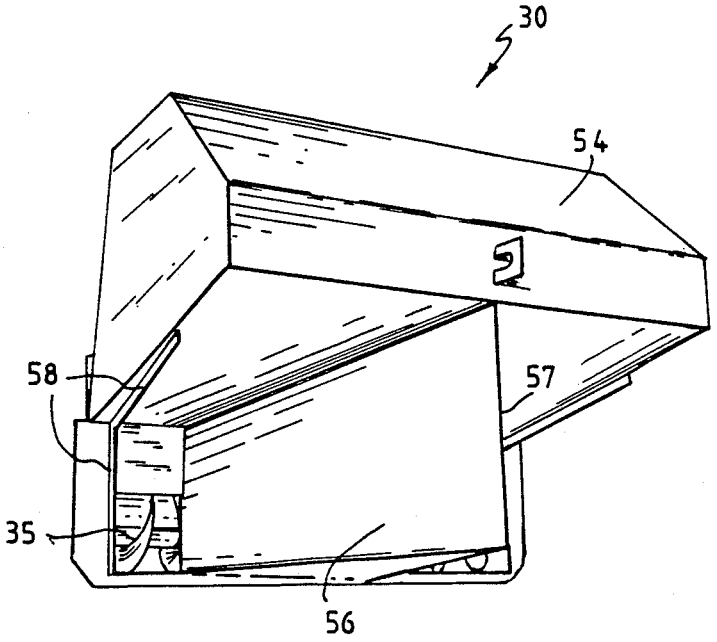
FIG. 5 is a perspective view from the other side of the dispensing apparatus of FIG. 3.

Referring to FIGS. 4 and 5 and also FIG. 3 the module 30 is illustrated as viewed from within the partitioned regions 33 and 34 of the tipping trailer of FIG. 3.

In the particular application of the invention illustrated in FIGS. 3–7, sand would normally be stored in region 34 and gravel would normally be stored in region 33. The drive gearing and auger size are selected to give the desired ratio of dispensed sand and gravel. The module 30 includes an upper storage section 54 in which water and cement powder are separately stored. The lower section 55 includes a V-shaped divider 56 having a spine 57 arranged to be contiguous with the partition 32 of the tipping trailer when the module 30 is operatively secured as in FIG. 3.

The lower wall of the upper section and the walls of the divider are convergent. In addition a further convergent wall section is normally bolted or welded to flanges 58 and has its near edge secured against the inner surface of the tipping trailer walls 39 and 40.

Hence, by providing the convergent walls mentioned above and by locating the base of the respective augers 35 and 36 level with trailer deck 59, the present invention ensures that as gravel and sand held in the regions 33 and 34 are dispensed the augers 35 and 36 are continually fed by gravity until the regions 33 and 34 are completely empty.

Where the material in regions 33 and 34 is not of a free flowing nature, it is desirable to line the deck, and in some cases the walls, with a low friction surface material such as stainless steel or polyurethane. In the case of damp sand, the sand may adhere to the deck thereby causing agglomerations of the sand to occur. A stainless steel deck surface in the tipping trailer minimises such adherance. It is preferable to tip the trailer to a minimum of approximately 55 degrees to the horizontal in order to optimise the dispensing of damp sand, a smaller angle being sufficient for dry sand. Other tilt angles will be appropriate for other materials.

Figure 6:
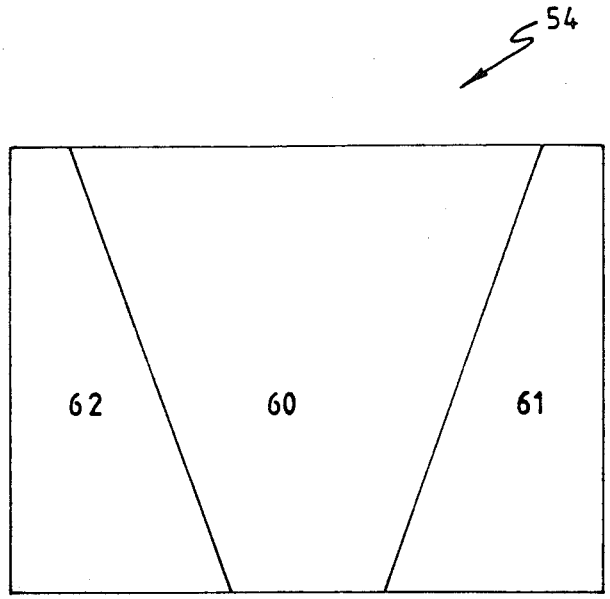
FIG. 6 is a cross-sectional view along A—A of FIG. 3.

Referring to FIG. 6 there is illustrated a cross-sectional view through the upper storage section 54 of module 30. The storage section is divided into three tanks, namely a cement powder tank 60 sandwiched between two water tanks 61 and 62.

The water tanks are linked to a common filler and also have a common outlet.

The cement powder tank 60 is a specialised container which is of pyramidal form with walls converging to the cement wheel 41. During transportation of the dispenser compaction of the cement powder may occur and the density of the compacted cement powder may vary from around 1250 kg per cubic metre to as much as 1600 kg per cubic metre. Such variation in the density of cement powder is undesirable since the resulting mix will be of variable and unpredictable character. To overcome this problem two perforated compressed air mats 65 and 66 are located across the forward and rearward internal walls of the cement powder tank. The air mats 65 and 66 are angled to prevent agglomeration of cement powder on the air mats and also direct the cement powder directly onto the blades of the cement wheel 41. Using this arrangement, compacted cement powder in a 1700 kg capacity tank can be fully aerated within about 1–2 minutes yielding a reproducible density of 1100 kg per cubic metre. The air mats 65 and 66 are supplied directly from the compressed air system of the tipping vehicle and operated from the main control panel.

Figure 7:
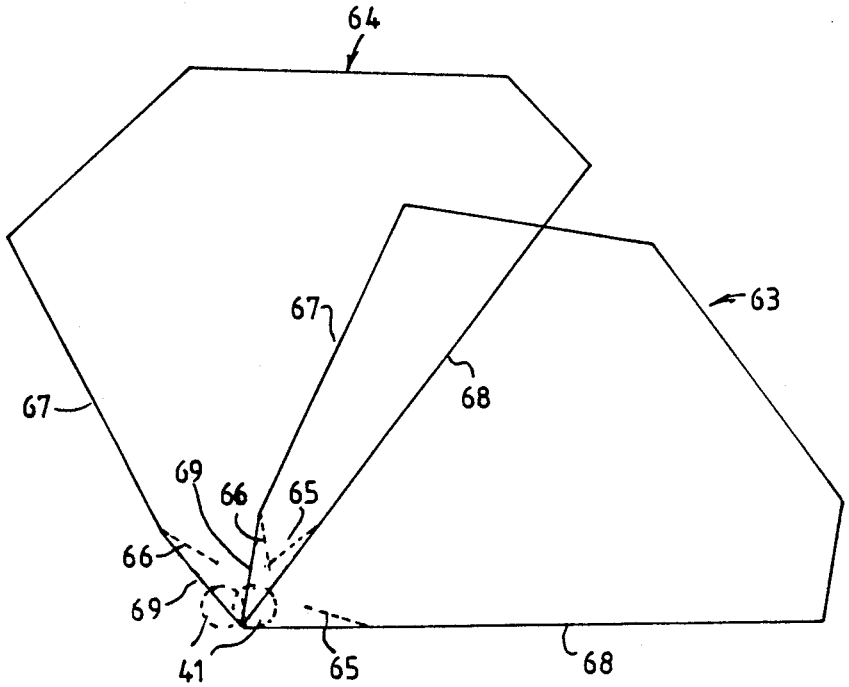
FIG. 7 is a cross-sectional view along B—B of FIG. 3 depicting the dispensing apparatus in both normal and tilted attitudes.

The extent of tipping illustrated in FIG. 7 at 64 is equivalent to the tipping body being at approximately 55 degrees to the horizontal. At this angle the central axis of the cement powder tank is substantially vertical and the tank is effectively inverted on its apex. Wall 67 of the tank makes approximately the same angle to the central axis as does wall 68 and the air mats direct cement powder as a vertical sheet onto the cement wheel 41. Section 69 is almost vertical when the dispenser is in the lowered attitude 63. The section 69 is therefore contiguous with main auger mounting plate 70 for simplicity of fabrication and driving the cement wheel from the common drive shaft.

Where the dispenser is intended to be used as a mobile unit in a conventional tip truck, a crane may be employed to lift the dispenser in and out of the tip truck. The dispenser may simply be bolted into the rear tailgate. Where a dedicated unit is required of course, the dispenser may be secured permanently in the rear of the tipping vehicle or may be manufactured integral with the body. The advantage of a removable dispenser is that use of the vehicle is not limited to concrete production as is the case with conventional agitators.

The dispenser of FIGS. 3 to 7 may be fitted with a mixer conveyor of the type illustrated in FIG. 2. At the construction site the cement powder is fully aerated and the trailer tipped to approximately 55 degrees. The water is gravity fed from the water tanks through two series valves. One valve is fine tuned to the desired wetness of the mix while the other valve merely serves an on-off function.

The cumulative total of mix to be dispensed is set on the control panel, the dispenser is switched on, and the on-off water valve, which may be solenoid driven, is also opened. Water, cement powder, sand and gravel are simultaneously dispensed into the mixer. The water content may be fine tuned to the level desired by the concrete finisher and this setting is usually retained for the total mix with the on-off valve only being operated in response to the dispenser being switched off.

It will be apparent to those skilled in the art that the invention eliminates the requirement for central batching plants, and bulk materials may be loaded directly into the tipper. Furthermore the concrete is mixed onsite as required and consequently there are no problems with premature curing or the preparation of too much or too little concrete.

Although the foregoing describes a specific application of my invention to the dispensing of concrete constituents, minor modifications of the dispenser may be made so that other substances may be dispensed. For example the dispenser can be used to dispense asphalt. Asphalt is primarily a mixture of gravel, sand and hot bitumen but may include other ingredients. In such a modified dispenser, an insulated tank with internal heating elements is provided so that the hot bitumen may be dispensed at a predetermined rate along with gravel and other bulk constituents from the tip truck. The modified dispenser may also include a tank holding kerosene for clean down of bitumen from the unit. A mixer of the type illustrated in FIG. 2 may be employed.

In another modified form the tank is filled with molasses which is dispensed along with particulate bulk animal feed from the tip truck as a blending for ruminants. In this modified form, the animal feed may be dispensed to the grazing stock while the truck is moving.

Further modifications and variations may be made to the dispenser by persons skilled in the art without departing from the broad scope and ambit of the invention as herein set forth and defined in the appended claims. In particular the invention is not limited by the materials being dispensed.

I claim:

1. A dispensing apparatus suitable for use with transportable container means for dispensing constituents of a desired mixture, said container means being tiltable between a substantially horizontal attitude and an inclined attitude in which one end of said container means is lower than another end of said container means and said apparatus being located at the lower end of the container means when inclined; wherein said apparatus comprises receiving means for receiving at least one constituent from said container means by gravitational delivery, first dispensing means for dispensing said at least one constituent received in said receiving means at a predetermined rate; storage means for storing at least one further constituent in said dispensing apparatus; and second dispensing means for dispensing said at least one further constituent from said storage means at a predetermined rate.

2. A dispensing apparatus as defined in claim 1, wherein said receiving means comprises at least one passage having an opening for receiving said at least one constituent from said container means, an outlet communicating with said first dispensing means, and convergent walls directing said at least one constituent received through said opening toward said first dispensing means.

3. A dispensing apparatus as defined in claim 1, wherein said container means includes two separate storage regions; and wherein said receiving means comprises two passages each having an outlet end and communicating with a respective storage region, said first dispensing means comprising an auger located at the outlet end of each respective passage.

4. A dispensing apparatus as defined in claim 1, wherein said storage means includes at least one container for storing said at least one further constituent at an elevated location relative to said second dispensing means when said container means is tilted to the inclined attitude.

5. A dispensing apparatus as defined in claim 4, wherein said container is of inverted pyramidal shape in said inclined attitude, said second dispensing means being located at a bottom of said container.

6. A dispensing apparatus as defined in claim 5, wherein said at least one further constituent is cement powder and wherein said pyramid shaped container includes at least one pressurized gas outlet, said gas outlet being located near and above said second dispensing means.

7. A dispensing apparatus as defined in claim 6, wherein said second dispensing means comprises a paddle-wheel dispenser including blades, and wherein said pressurized gas outlet comprises first and second compressed air mats, said air mats being located on opposed interior surfaces of said container for directing cement powder contained therein onto the blades of said paddle-wheel dispenser.

8. A dispensing apparatus as defined in claim 1, wherein first dispensing means comprises at least one auger, and said second dispensing means comprises at least one paddle-wheel dispenser, said first and second dispensing means being driven from a common drive.

9. A dispensing apparatus as defined in claim 1, wherein said at least one constituent and said at least one further constituent are dispensed by said first and second dispensing means, respectively to a common location to effect at least partial mixing of said at least one constituent and at least one further constituent.

10. A further dispensing apparatus as defined in claim 1, further comprising common drive means for said first and second dispensing means.

11. A dispensing apparatus operatively securable in a rearward end of a tip truck tray tiltable between a substantially horizontal attitude and an inclined attitude and including a plurality of sections, the apparatus comprising an upper storage section, a lower section, a controller, and drive means;

said upper storage section having dispensing outlets driven by said drive means for dispensing material stored in said upper storage section;

said lower section defining a plurality of through passages having forward ends and rear ends, communicating at said forward ends with respective sections of said tip truck tray and at said rear ends with respective dispensing outlets driven by said drive means for dispensing material from respective through passages, said through passages being adapted to receive material from respective sections of said tip truck tray by gravitational delivery when said tray is tilted to the inclined attitude; and said controller being operable to vary relative amounts dispensed by said dispensing outlets.

12. A dispensing apparatus as defined in claim 11, wherein said upper storage section is adapted to pivot from a transport position when said tray is in said substantially horizontal attitude to a dispensing position when said tray is tilted to said inclined attitude.

13. A dispensing apparatus as defined in claim 11, wherein said lower section comprises a plurality of wall members defining said passages, said wall members being convergent towards the rear end of each of said passages.

* * * * *